United States Patent [19]

Mauch et al.

[11] 4,258,687

[45] Mar. 31, 1981

[54] ENGINE WITH INTEGRAL MOUNTED EGR COOLER

[75] Inventors: Jerry L. Mauch; Howard A. Aula, both of Dearborn Heights, Mich.

[73] Assignee: Ford Motor Company, Dearborn, Mich.

[21] Appl. No.: 83,015

[22] Filed: Oct. 9, 1979

[51] Int. Cl.[3] ..... F02B 47/08

[52] U.S. Cl. ..... 123/570; 123/52 MV

[58] Field of Search ..... 123/119 A, 52 MV

[56] References Cited

U.S. PATENT DOCUMENTS

| | | | |
|---|---|---|---|
| 3,937,196 | 2/1976 | Cook et al. | 123/119 A |
| 3,951,115 | 4/1976 | Brisko | 123/119 A |
| 3,961,616 | 6/1976 | Brown | 123/119 A |
| 4,055,158 | 10/1977 | Marsee | 123/119 A |
| 4,058,098 | 11/1977 | Onaka | 123/119 A |
| 4,072,133 | 2/1978 | McWhirter | 123/119 A |
| 4,094,283 | 6/1978 | Sutton | 123/119 A |
| 4,119,071 | 10/1978 | Hattori | 123/119 A |
| 4,147,141 | 4/1979 | Nagano | 123/119 A |
| 4,192,266 | 3/1980 | Duckworth | 123/119 A |

*Primary Examiner*—Wendell E. Burns
*Attorney, Agent, or Firm*—Robert E. McCollum; Clifford L. Sadler

[57] ABSTRACT

An automotive type V-8 engine has an exhaust gas recirculation (EGR) system wholly contained within its intake manifold, and a flat, sandwich type EGR cooler is constructed to be integrally mounted to the underside of the manifold in the valley of the V-8 over the combination valley cover-manifold gasket, without the use of hoses, clamps and other paraphenalia normally associated with externally mounted EGR coolers.

6 Claims, 14 Drawing Figures

ENGINE WITH INTEGRAL MOUNTED EGR COOLER

This invention relates in general to an exhaust gas recirculation (EGR) system for an automotive type internal combustion engine. More particularly, the invention relates to a heat exchanger that is integral with the engine intake manifold for cooling the exhaust gases prior to their reentry into the engine, to lower fuel evaporative losses and to provide a better engine operating efficiency.

EGR coolers per se are not new. For example, U.S. Pat. No. 3,937,196, Cook, shows and describes an internally mounted EGR cooler. In this case, the intake manifold is designed specifically to accept such a cooler. Such design, however, generally will be more complicated and less economical than a conventional intake manifold with an externally mounted EGR cooler.

On the other hand, FIG. 1 shows a known type of externally mounted EGR cooler 1 in which water or engine coolant is circulated between tubes 2 and 4 through an outer cylinder of the cooler that contains an internal cylinder through which exhaust gases flow from a tube 6 to a conduit 8 to be recirculated into the engine through an EGR valve 9. This system is typical of many of the externally mounted EGR coolers in that it is a mish-mash of tubes, insulator socks, brackets, hoses, clamps and fittings providing an awkward arrangement.

This invention relates to an EGR cooler construction that can be mounted integral to the underside of an essentially conventional intake manifold in the valley of a V-8 type engine. More specifically, the invention relates to a V-8 engine construction in which an EGR system is totally contained within the intake manifold, and an EGR cooler is constructed to be contiguous to the underside of the manifold in the valley between the two banks of engine cylinders.

It is a still further object of the invention to provide an EGR cooler that is mounted integral with the underside of the engine intake manifold, eliminating the usual external tubes, hoses, insulator socks, brackets and other paraphernalia usually associated with an externally mounted EGR cooler.

Another object of the invention is to provide a simplified construction of an EGR cooler that can be contained within the space between the intake manifold and valley cover of a V-8 type engine.

Other objects, features and advantages of the invention will become more apparent upon reference to the succeeding, detailed description thereof, and to the drawings illustrating the preferred embodiment thereof; wherein, FIG. 1 is a view of an EGR cooler assembly known in the prior art;

FIG. 2 schematically illustrates, in exploded view form, a V-8 type engine construction embodying the invention;

Figure 1:
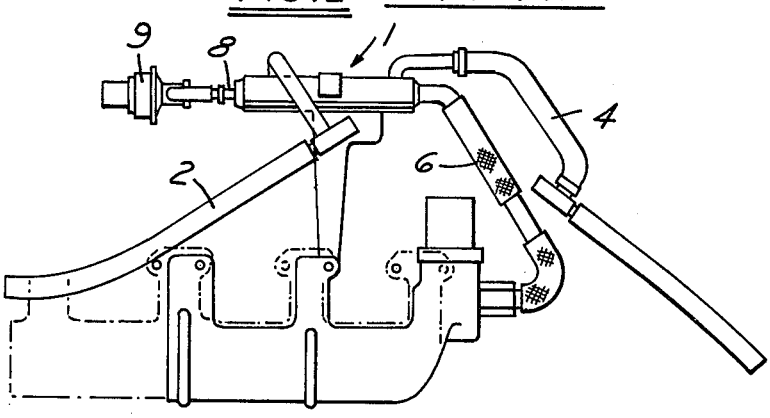
FIG. 1 PRIOR ART
Figure 7:
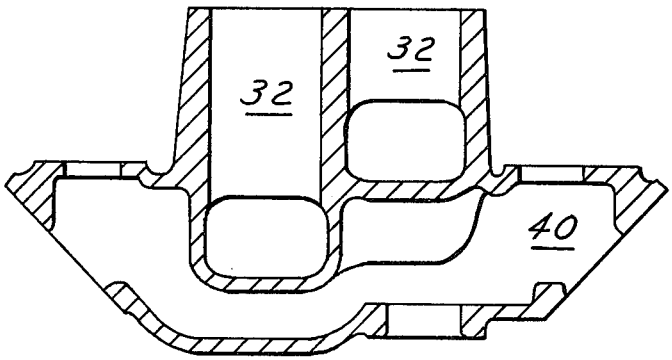
Figure 8:
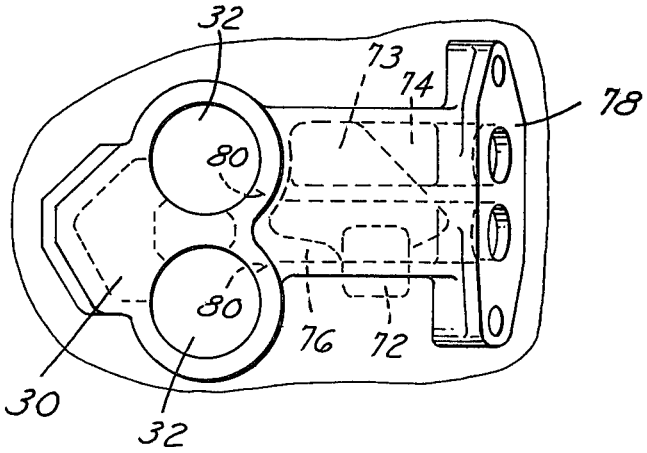
Figure 3:
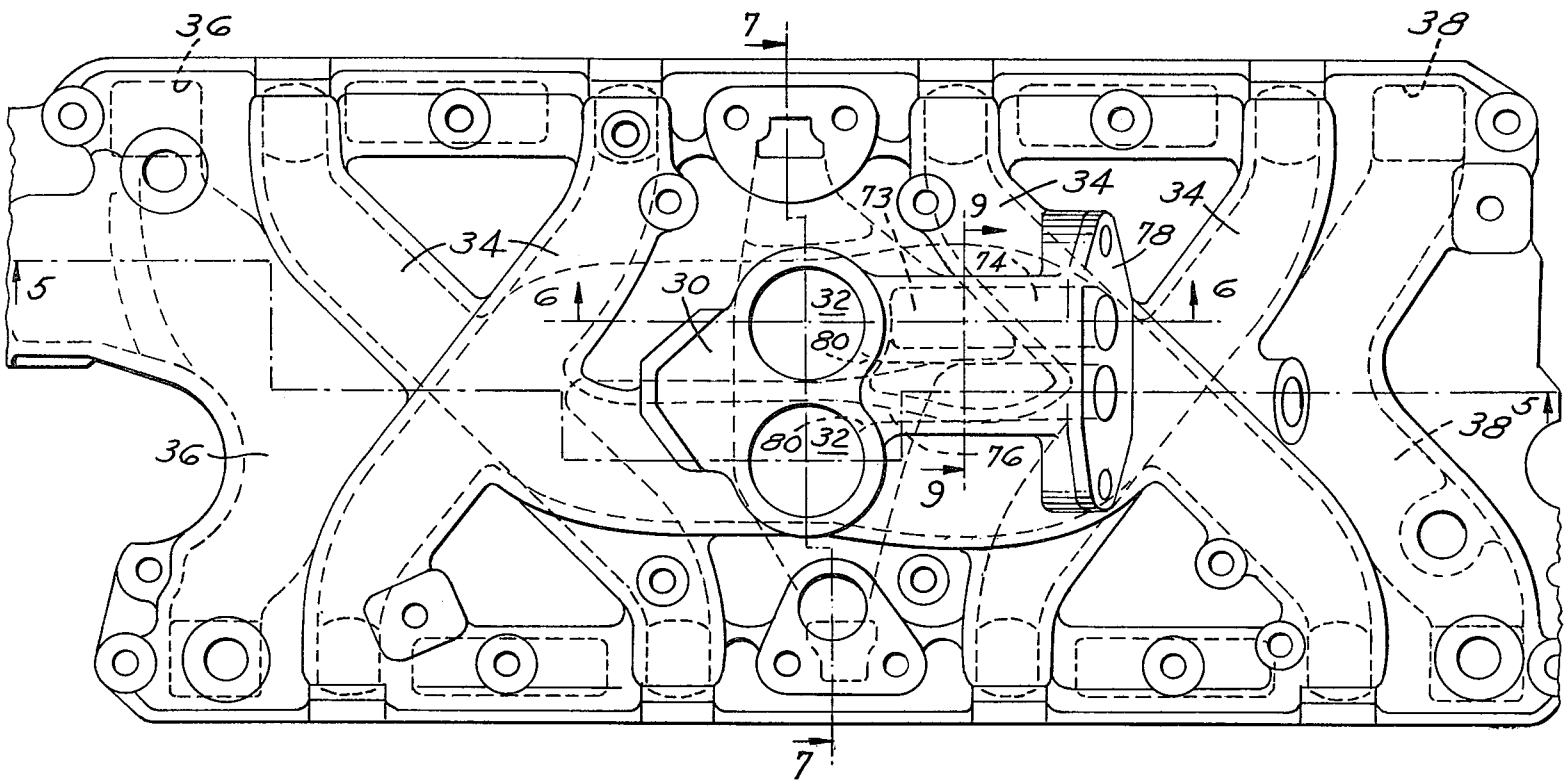
FIG. 3 is an enlarged top or plan view of the intake manifold shown in FIG. 2.
Figure 5:
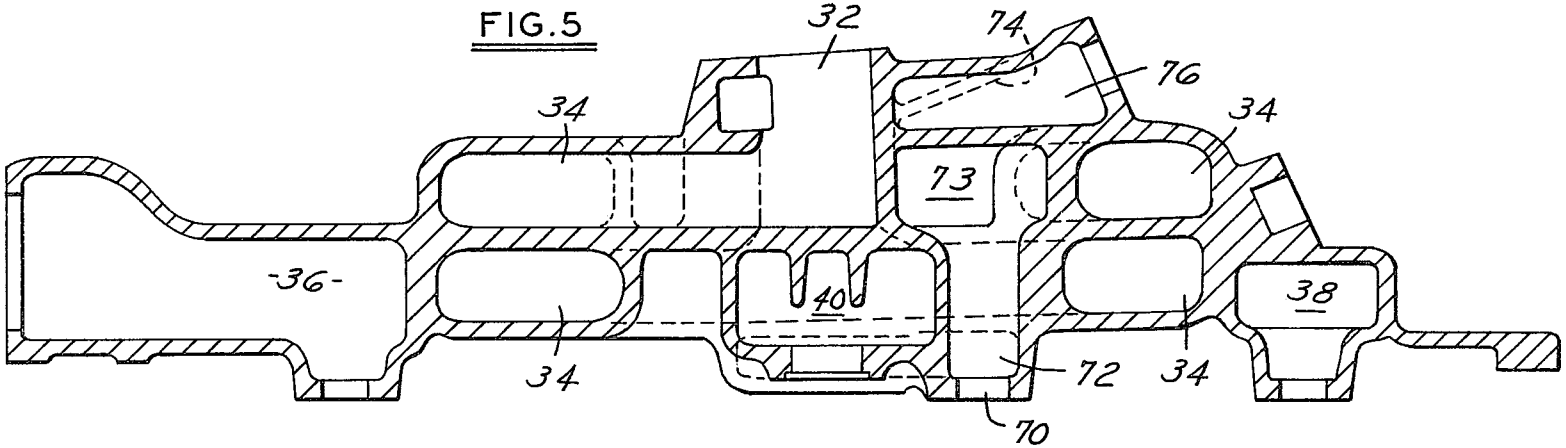
Figure 6:
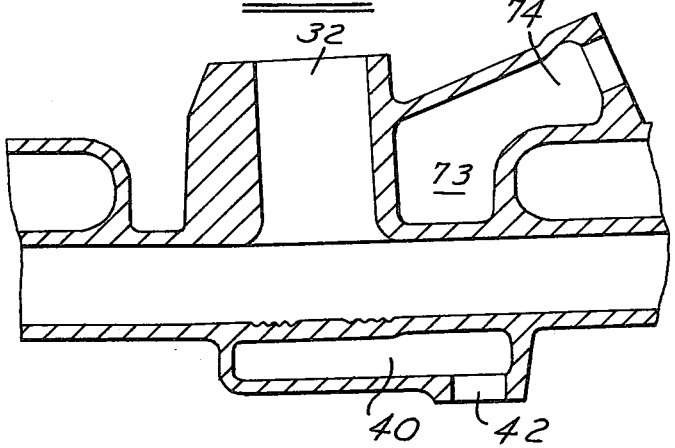
Figure 9:
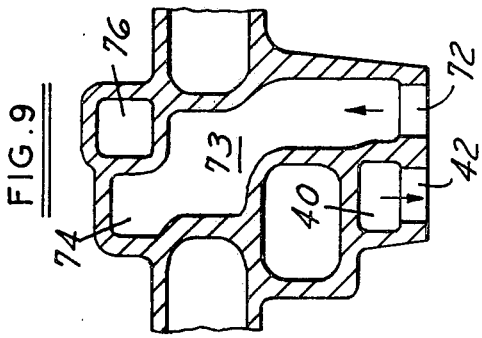
Figure 10:
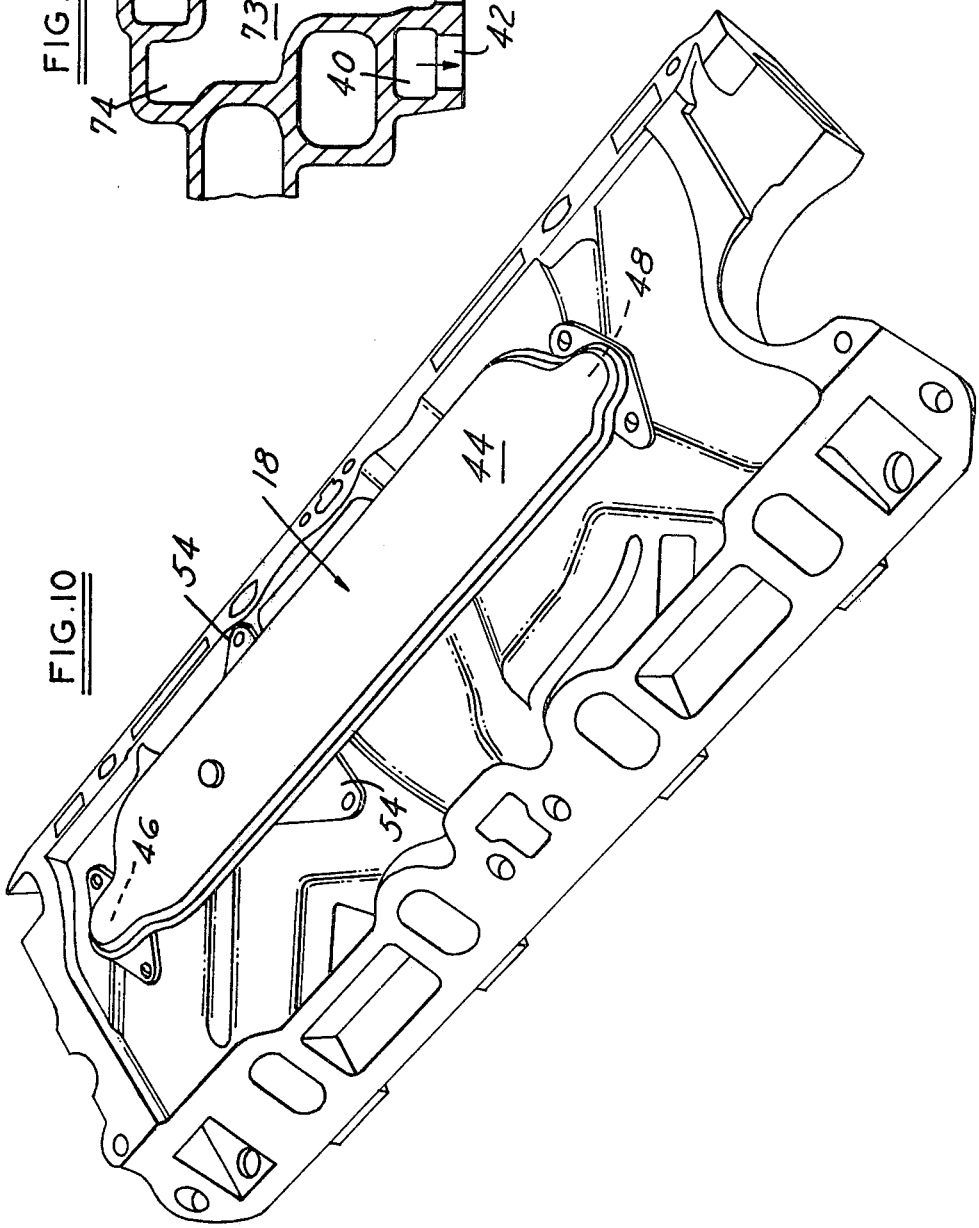
Figure 11:
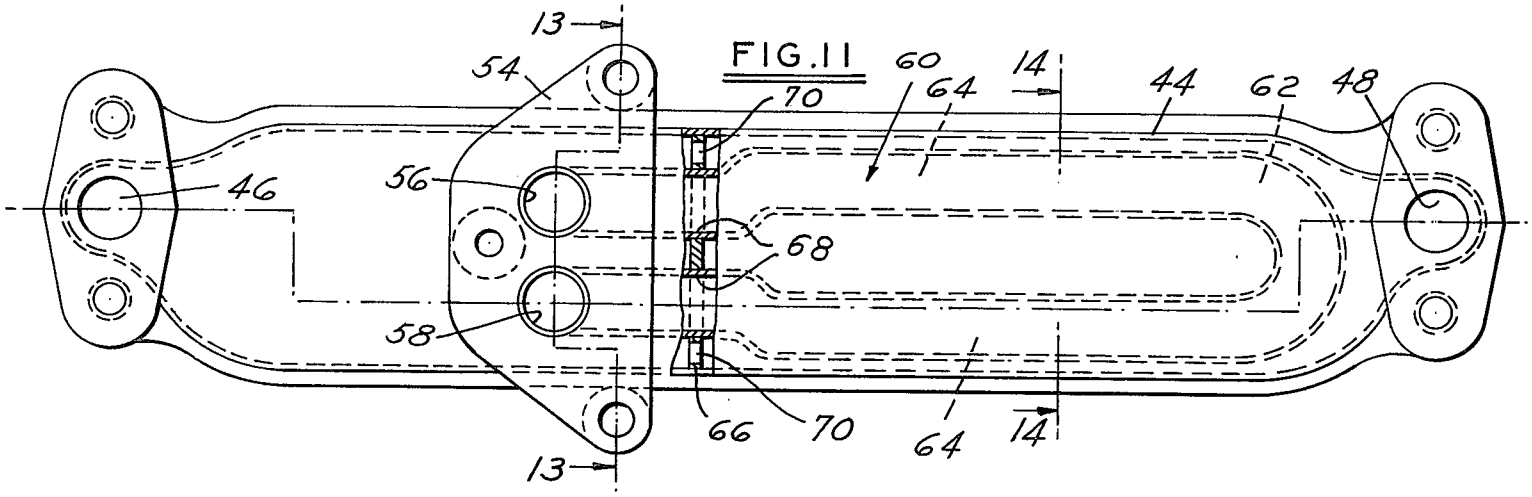
Figure 12:
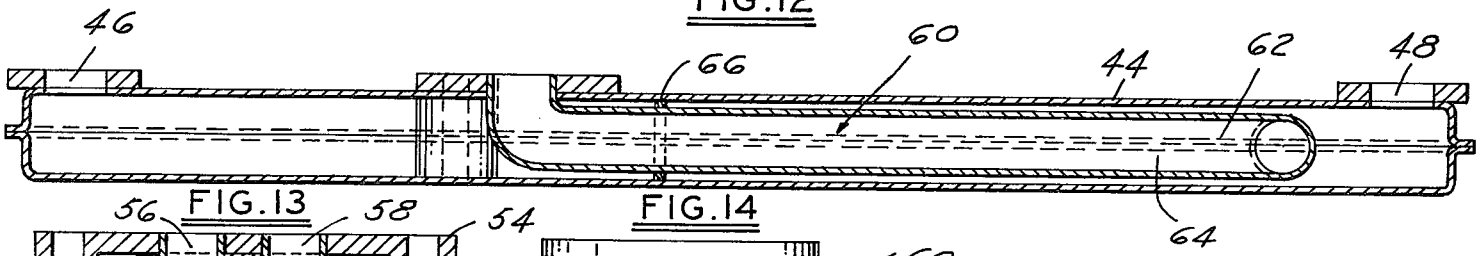
Figure 14:
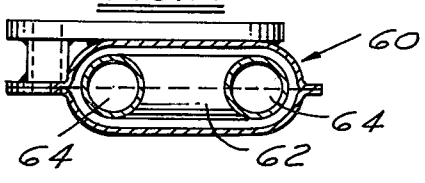
Figure 13:
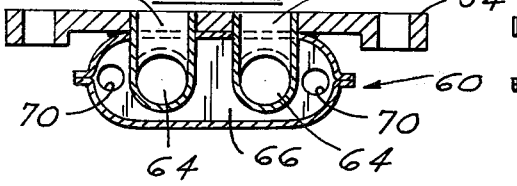

FIGS. 5 and 6 and 7 are cross-sectional views of portions of the intake manifold taken on planes indicated by and viewed in the direction of the arrows 5—5 and 6—6 and 7—7 of FIG. 3, and illustrating the path of movement of the EGR gases;

FIG. 8 is a reproduction of a portion of FIG. 3;

FIG. 9 is a cross-sectional view taken on a plane indicated by and viewed in the direction of the arrows 9—9 of FIG. 3;

FIG. 10 is a perspective view of the cooler installed on the intake manifold;

FIG. 11 is an enlarged plan view of the cooler shown in FIG. 10;

FIG. 12 is a longitudinal cross-sectional view taken on a plane indicated by and viewed in the direction of the arrows 12—12 of FIG. 11; and, FIGS. 13 and 14 are cross-sectional views taken on planes indicated by and viewed in the direction of the arrows 13—13 and 14—14, respectively, of FIG. 11.

As indicated previously, the invention relates to the provision of an EGR cooler that can be easily integrated into a V-8 type engine construction, without incorporating the usual hoses, clamps, tubes and other paraphenalia normally associated with externally mounted EGR coolers. In this instance, the EGR cooler is snugly received in a nesting manner beneath the intake manifold in the valley of the V-8 and cooperatingly constructed to coact with internal EGR passages in the intake manifold.

Figure 2:
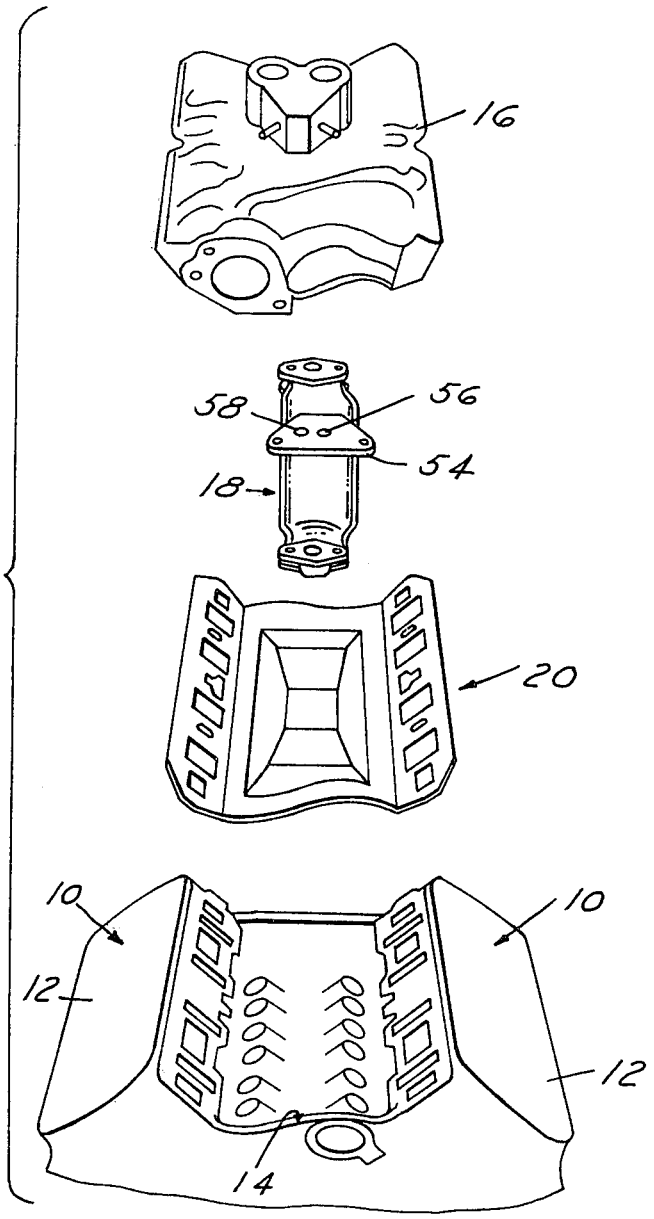

FIG. 2 illustrates in a schematic exploded view an automative type internal combustion engine of the conventional V-8 type. It consists of the normal dual bank of engine cylinders or blocks 10 that are joined at their lower or bottom crankcase ends and spaced laterally from one another at their upper cylinder head assembly ends 12, as shown. This defines the usual valley 14 within which normally is mounted a single intake manifold 16 having passages interconnecting the two cylinder blocks. In this case, as illustrated, a compact, flat sandwich type EGR cooler 18 is fitted between the bottom of the intake manifold and a combination cover-gasket 20 normally provided for the valley. As will be described, the EGR cooler 18 is integrally mounted to the underside of the intake manifold and has passages for circulation of engine coolant through it and around a tubular member that contains the EGR gas to be recirculated into the engine, as previously described.

FIG. 3 is a top view of the intake manifold shown in FIG. 2. It contains the usual carburetor mounting flange 30 having two riser bores 32 that are adapted to mate with the riser bores of a downdraft type carburetor (not shown). The bores are interconnected with the conventional logs or runners 34 that connect at opposite edges to the engine cylinder heads for distribution of the air/fuel mixture from the carburetor into the engine proper. The manifold also contains front and rear water passages 36 and 38 for the flow of engine coolant between the cylinder blocks and heads in a known manner.

Figure 4:
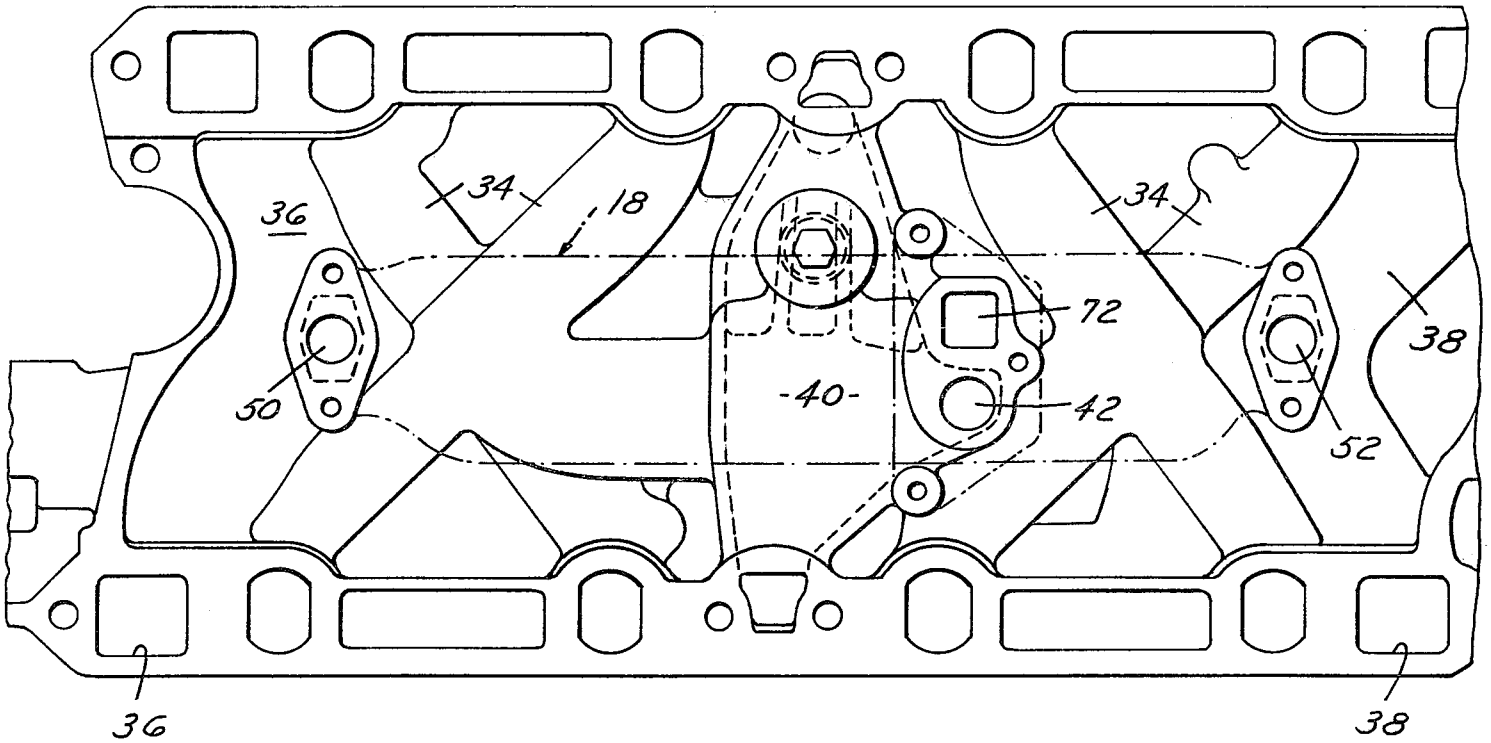
FIG. 4 is a bottom view of the intake manifold shown in FIG. 3, looking up.

As best seen in FIGS. 4, 5, and 7 the manifold also contains an exhaust gas crossover passage 40 connecting the exhaust gases from one bank of engine cylinder to the opposite bank, flowing directly beneath the riser bores 32 for evaporating liquid fuel in the air/fuel mixture prior to its entry into the engine cylinders.

Exhaust gas recirculation (EGR) systems have been in use on automotive engine installations for many years to control the production of NOx. The usual construction is to tap the exhaust gas crossover passage 40 for a supply of exhaust gases, and redirect this portion of the gases into the engine intake manifold generally at a location below the throttle valve of the carburetor and above the inlet to the intake manifold. This generally lowers the combustion chamber pressures and temperatures to reduce the output of NOx. The use of hot exhaust gases, however, may lead to a greater evaporation of the air/fuel mixture flowing through the carburetor than is desired. Accordingly, an EGR cooler may be desired to cool the exhaust gases prior to their reentering the intake manifold on their way to the engine cylinders.

This invention relates to an EGR system that is essentially totally contained within the intake manifold, and is primarily concerned with an EGR cooler that is mounted integral to the manifold without the usual appertinences, so as to simplify the construction and provide better assembly reliability.

Turning now to FIGS. 4–6 and 9, the EGR passage 40 is provided with a gas outlet or discharge opening 42 for the passage of EGR gases downwardly out of the intake manifold. Bolted directly to the underside of the intake manifold is a flat, sandwich-shaped EGR cooler 18 which, as best seen in FIGS. 10–14, has an elongated oblong type hollow casing 44. The casing is provided with flanged openings at opposite ends constituting an engine coolant inlet 46 and a coolant outlet 48. These openings are aligned directly with mating openings 52 and 50 in the manifold coolant passages 38 and 36. The casing 44 also contains a third mounting flange 54 that contains a pair of openings 56 and 58. Secured within the latter openings are the open ends of a tube 60 that is bent into a U-shape to provide an arcuately shaped base portion 62 and a pair of legs or leg portions 64 extending from it. The side or leg portions are spaced laterally from each other by a partition-like combination support-spacer 66 that is fixedly secured within casing 44 closely adjacent to flange 54. The support-spacer 66 has a first pair of spaced holes 68 through which are inserted the legs 64 of the U-shaped tube. A second set of arcuately shaped holes 70 is also provided to permit the flow of water or engine coolant through casing 44 from inlet 46 to outlet 48 past all portions of the tube 60. The tube is shown as tapering or diverging outwardly directly downstream of support-spacer 66 to provide a greater heat transfer or heat exchange between the engine coolant and the walls of the U-shaped tube.

The tube in this case is adapted to contain and flow exhaust gases from the engine EGR system that in this case is totally contained within the intake manifold. The opening 56, therefore, is adapted to be aligned with the gas outlet 42 from the engine exhaust gas crossover passage 40, with the flange 54 being secured directly to the underside of the intake manifold. The opening 56 in the casing of the EGR cooler, therefore, constitutes an outlet for the flow of cooled exhaust gases into an opening 72 provided in the intake manifold for flow upwardly and diagonally through a passage 73, as indicated in FIG. 9. As best seen in FIG. 8, the topside of the intake manifold is cored to provide a pair of essentially parallel passages 74 and 76 terminating in a mounting flange 78. Passage 74 is connected directly to the diagonal passage 73 to receive the cooled exhaust gases. Passage 76 on the other hand is connected through dual ports 80 directly into the riser bores 32. The exhaust gases in passage 74 at times will be connected with the passage 76 so that they then can flow into the riser bores 32 and be circulated into the intake manifold and therethrough to the engine cylinders.

The mounting flange 78 in this case is adapted to support a known type of reciprocating EGR control valve (not shown) that would be movable either electronically, by vacuum or other suitable means to block or unblock communication between the two passages 74 and 76, in a known manner. In brief, the flow of exhaust gases generally is not desired during engine idle speed and wide open throttle conditions of operation, since at engine idle, the scavenging of exhaust gases is not as efficient as at off idle speeds of operation, and at wide open throttle conditions of operation, the maximum power output is determined by the availability of oxygen. Accordingly, the EGR valve normally will close off the connection between passages 74 and 76 to prevent passage of EGR gases into the throttle riser bores at these times, and will schedule the flow of EGR gases generally only during off idle, part load conditions of operation.

As thus described, therefore, it will be seen that the engine water or coolant, as the case may be, flows through the intake manifold passage 38 and out the opening 52 into the inlet 46 of the EGR cooler. The coolant then flows longitudinally through the casing 44 towards the coolant outlet 48, passing through holes 70 to totally surround the legs and base of the U-shaped EGR cooler tube 60. It thereby provides a transfer of heat from the hot exhaust gases to the cooler engine coolant. The coolant then passes out into the intake manifold passage 36 at the rear of the engine for flow to the engine radiator to be cooled and recycled for use again in the cooler and other portions of the engine. During this time, a portion of the exhaust gases flowing through the crossover passage 40 are diverted into the outlet 42 and into the inlet 56 of the U-shaped tube 60. From there, the EGR gases flow around the circuit of the U-shaped tube and out the outlet 58 into the diagonally located passage 73 and into passage 74. If the EGR valve is in an open condition, the exhaust gases will continue to be pulled, by reason of the engine intake manifold vacuum, into the riser bores 32 through the openings 80.

FIGS. 11–14 illustrate more clearly the specific construction of the EGR cooler 18. As stated previously, it has the three mounting flanges adapted to be attached to matingly shaped flanges formed on the underside of the intake manifold, the openings 56 and 58 cooperating with the inlet and outlet 42 and 72, respectively. FIGS. 13–14 more clearly show the cross-sectional constructions.

From the foregoing, it will be seen that the invention provides an EGR cooler that can be mounted directly to the underside of the engine intake manifold in the valley of a V-8 type engine thus providing a compact and simplified construction without the use of additional brackets, hoses, fittings and clamps. The simplification of this design provides improved assembly reliability, lower assembly costs, reduced weight and an improved EGR system and engine function. The integral EGR cooler and manifold system also provides an improved package that minimizes damage in engine shipment and in engine installation at the vehicle assembly plants.

While the invention has been shown and illustrated in its preferred embodiment, it will be clear to those skilled in the arts to which it pertains that many changes and modifications may be made thereto without departing from the scope of the invention.

We claim:

1. An internal combustion engine of the V-type having a dual bank of cylinder blocks joined at the bottom crankcase end and spaced laterally from each other at their top cylinder head ends to provide a V-shaped valley therebetween, the valley nestledly receiving therein in a mating manner a single engine intake manifold connecting the blocks, the intake manifold including an exhaust gas recirculation (EGR) system, and an engine coolant cooled EGR gas cooler mounted integral to the underside of the manifold in the valley and connected to the EGR system for cooling of the EGR gases by engine coolant.

2. An engine as in claim 1, the EGR system being totally contained within the intake manifold for the flow of exhaust gases from the exhaust manifold through the intake manifold to the engine cylinders.

3. An internal combustion engine of the V-type having a dual bank of cylinder blocks joined at the bottom crankcase end and spaced laterally from each other at their top cylinder head ends to provide a V-shaped valley therebetween, the valley nestledly receiving therein in a mating manner a single engine intake manifold connecting the blocks, and an engine exhaust gas recirculation (EGR) gas cooler mounted integral to the underside of the manifold in the valley, the intake manifold including an EGR system including exhaust gas flow passages totally contained therein connecting engine exhaust gases to carburetor air/fuel flow inlet riser bores integral with the manifold and adapted to be connected to an EGR control valve mechanism operable to control flow through the passages, the cooler having an engine coolant inlet and an outlet each connected to the engine coolant flow passages, the cooler also having an EGR gas inlet and outlet connected to the exhaust gas flow passages for cooling of the EGR gases by the engine coolant.

4. An engine as in claim 3, including a combination valley cover and gasket located in the valley beneath the intake manifold, the cooler being nestled between the intake manifold and the cover-gasket.

5. An engine as in claim 4, the cooler being flat so as to nestle between the cover and intake manifold.

6. An engine as in claim 3, the intake manifold containing an exhaust gas crossover passage connected at opposite ends to the exhaust manifold in each bank, the latter passage containing a connection to the gas inlet of the EGR gas cooler, the EGR gas outlet bypassing the crossover passage and being adapted to be connected to the EGR control valve mechanism.

* * * * *